US010711377B2

(12) United States Patent
Christian

(10) Patent No.: US 10,711,377 B2
(45) Date of Patent: Jul. 14, 2020

(54) KNITTING NEEDLES AND CROCHET HOOKS AND SYSTEMS

(71) Applicant: Ruth Ann Christian, Chocowinity, NC (US)

(72) Inventor: Ruth Ann Christian, Chocowinity, NC (US)

( * ) Notice: Subject to any disclaimer, the term of this patent is extended or adjusted under 35 U.S.C. 154(b) by 413 days.

(21) Appl. No.: 15/207,588

(22) Filed: Jul. 12, 2016

(65) Prior Publication Data

US 2018/0016716 A1 Jan. 18, 2018

(51) Int. Cl.

| | |
|---|---|
| ***D04B 3/00*** | (2006.01) |
| ***D04B 3/02*** | (2006.01) |
| ***D04B 37/00*** | (2006.01) |
| ***D04B 31/00*** | (2006.01) |

(52) U.S. Cl.

CPC ..... *D04B 3/00* (2013.01); *D04B 3/02* (2013.01); *D04B 31/00* (2013.01); *D04B 37/00* (2013.01)

(58) Field of Classification Search

CPC ..... D04B 3/00; D04B 3/02
See application file for complete search history.

(56) References Cited

U.S. PATENT DOCUMENTS 2,188,823 A * 1/1940 Stallman ..... D04B 3/02 235/1 R
2,276,062 A * 3/1942 Peyser ..... G06M 1/00 235/114
2,486,184 A * 10/1949 Maker ..... D04B 17/04 66/117
2,980,329 A 4/1961 Hoffmann
3,039,684 A * 6/1962 Sanders ..... G06M 1/163 235/117 R
3,064,888 A 11/1962 Van De Mark
3,120,924 A 2/1964 Van De Mark
3,652,173 A 3/1972 Miller et al.
3,819,282 A 6/1974 Schultz
3,893,073 A 7/1975 Angello
4,303,996 A 12/1981 Schmitz
4,343,160 A * 8/1982 Ponthus born Turquet ..... D04B 3/02 66/1 A
4,518,266 A 5/1985 Dawley
(Continued)

FOREIGN PATENT DOCUMENTS

DE 4012123 A1 * 9/1990 ..... D04B 3/02
FR 2417566 A1 * 9/1979 ..... D04B 3/02
(Continued)

*Primary Examiner* — Megan E Lynch
(74) *Attorney, Agent, or Firm* — Jenkins, Wilson, Taylor & Hunt, P.A.

(57) ABSTRACT

Crochet hooks and knitting needles configured with devices and systems to assist a user in counting, tracking and following a crocheting or knitting pattern, either automatically or manually. A crochet hook or knitting needle is provided with an integrated electronic or manual counting system or device. The integrated counting systems and devices can include an electronic or manual display, a button/sensor and/or an accelerometer configured to detect a motion. The integrated counting systems and devices can also include an integrated computer, power source and software. The integrated counting systems and devices can also include wireless communication devices, optical devices, speakers, tactile signal devices and/or audio devices.

17 Claims, 4 Drawing Sheets

(56) References Cited

U.S. PATENT DOCUMENTS

| | | | | |
|---|---|---|---|---|
| 4,764,943 | A | 8/1988 | Okada | |
| 5,020,527 | A | 6/1991 | Dessertine | |
| 5,279,585 | A | 1/1994 | Balkwill | |
| 5,411,173 | A | 5/1995 | Weinstein | |
| 6,213,954 | B1 | 4/2001 | Chen | |
| 7,172,358 | B1 | 2/2007 | Rudelius et al. | |
| 7,874,181 | B1 | 1/2011 | Lindahl | |
| 8,529,263 | B1 | 9/2013 | Smith et al. | |
| 2003/0111005 | A1 | 6/2003 | Lord et al. | |
| 2012/0296465 | A1* | 11/2012 | Felice | D04B 3/00 700/141 |
| 2013/0197479 | A1 | 8/2013 | Butler et al. | |
| 2014/0285475 | A1* | 9/2014 | Ogata | G06F 3/03545 345/175 |
| 2014/0374301 | A1 | 12/2014 | West | |
| 2015/0240398 | A1* | 8/2015 | Selter | D04B 3/02 66/117 |

FOREIGN PATENT DOCUMENTS

| | | | | | |
|---|---|---|---|---|---|
| FR | 2451409 | A2 | * | 10/1980 | D04B 3/02 |
| GB | 408594 | A | * | 4/1934 | D04B 3/00 |
| GB | 520604 | A | * | 4/1940 | D04B 3/00 |

* cited by examiner

KNITTING NEEDLES AND CROCHET HOOKS AND SYSTEMS

TECHNICAL FIELD

The presently disclosed subject matter relates to knitting and crocheting needles and systems. The presently disclosed subject matter also relates to knitting and crocheting needles configured with devices and systems to assist a user in counting, tracking and following a knitting or crocheting pattern.

BACKGROUND

Knitting and crocheting are traditional forms of weaving yarns and other materials that require a lot of time and patience. In performing either knitting and crocheting, or related stitching methodologies, an accidental omission in making a stitch or loop can result in undoing rows worth of work, which can waste time and frustrate the person knitting or crocheting.

To maintain an accurate pattern count or otherwise keep track of stitches and patterns during knitting or crocheting a user can use a counting device or system. Standard counting devices used to maintain count of knitted or crocheted row or round numbers that correspond to a particular pattern are tools separate from the needle(s) or hook(s) and require manual manipulation by the user to cause the count to move forward. However, available counting devices require a method of manipulation that causes the user to remove his/her hands from the needle(s)/hook(s). The user must then reposition his/her hands on the needle(s)/hook(s) and yarn to continue to knit or crochet, thereby creating an inefficiency and interruption of work flow. Thus, what is needed is a device and/or system to assist in counting and/or tracking a knitting or crocheting pattern that is user-friendly and does not cause an interruption in the user's progress.

Moreover, knitting and crocheting usually requires the use of three or more different tools, including for example a set of knitting needles or a crochet hook, a counting device to keep track of stitches, rows or rounds, and instructions or a pattern. To facilitate ease of use and increase efficiency what is needed is an integrated system or device combining one or more of these tools and/or features.

SUMMARY

The presently disclosed subject matter provides knitting and crocheting needles and systems. The presently disclosed subject matter also provides knitting and crocheting needles configured with devices and systems to assist a user in counting, tracking and following a knitting or crocheting pattern.

In some embodiments provided herein is a crochet hook or knitting needle with an integrated counting device, comprising a cylindrical shaft comprising a first end and a second end, wherein the first end comprises a hook or point, and wherein the second end comprises a blunt end, and a counting device integrated into the cylindrical shaft, the counting device comprising a rotatable member encased in a housing, wherein the rotatable member can rotate within the housing, a series of symbols on a surface of the rotatable member, an opening in the housing or a transparent portion of the shaft through which at least one of the symbols in the series of symbols can be viewed, and an advancing member configured to rotate the rotatable member such that the at least one symbol viewable in the opening of the housing is advanced to the next symbol in the series of symbols, wherein the counting device is integrated into the cylindrical shaft of the crochet hook or knitting needle.

In some embodiments the cylindrical shaft has a length of about 7 to about 38 cm, and a diameter of about 0.6 mm to about 25 mm. In some embodiments provided herein the cylindrical shaft can be made of wood, plastic, metal, glass or ivory. In some embodiments provided herein the integrated counting device is integrated into the cylindrical shaft and near the blunt end. In some embodiments provided herein the series of symbols comprise one or more of numbers, letters, characters or pictures. In some embodiments provided herein the advancing member comprises a knob portion mechanically linked to rotatable member, wherein the application of a rotational force to the knob results in a transfer of the rotational force to rotatable member to thereby advance the next symbol in the series of symbols. In some embodiments provided herein the advancing member comprises a depressible button mechanically linked to rotatable member, wherein the depressible button is configured to translate a directional movement of the button to a rotational movement of the rotatable member to thereby advance the next symbol in the series of symbols. In some embodiments provided herein the advancing member comprises a knob portion mechanically linked to rotatable member, wherein the application of a rotational force to the knob results in a transfer of the rotational force to rotatable member to thereby advance the next symbol in the series of symbols, and wherein the advancing member comprises a depressible button mechanically linked to rotatable member, wherein the depressible button is configured to translate a directional movement of the button to a rotational movement of the rotatable member to thereby advance the next symbol in the series of symbols.

In some embodiments provided herein is a crochet hook or knitting needle with an integrated electronic counting system, comprising a cylindrical shaft comprising a first end and a second end, wherein the first end comprises a hook or point, and wherein the second end comprises a blunt end, and an electronic counting system integrated into the cylindrical shaft, the counting system comprising a button, and an electronic display, speaker or tactile signal device, wherein the button is in electrical communication with the electronic display, speaker or tactile signal device and configured to advance the counting system by sending an electrical signal to the electronic display, speaker or tactile signal device upon an activation of the button, wherein the counting system is integrated into the cylindrical shaft of the crochet hook or knitting needle.

In some embodiments provided herein the integrated counting system is integrated into the cylindrical shaft, wherein the electronic display is located near the blunt end. In some embodiments provided herein the electronic display is configured to display a series of symbols, wherein the series of symbols comprises one or more of numbers, letters, characters or pictures. In some embodiments provided herein the electronic display comprises a light emitting diode (LED). In some embodiments provided herein the crochet hook or knitting needle comprises a first button and a second button, wherein the first and second buttons are in electrical communication with the electronic display, speaker or tactile signal device and configured to advance the counting system by sending an electrical signal to the electronic display, speaker or tactile signal device upon an activation of one or both of the first and second buttons. In some embodiments provided herein one or both of the first and second buttons are depressible buttons, wherein an activation comprises depression of the depressible button. In some embodiments provided herein one or both of the first and second buttons are sensors, wherein an activation comprises an object covering or passing over one or both of the first and second buttons. In some embodiments provided herein the first button is located along the length of the cylindrical shaft, and wherein the second button is located at the blunt end of the cylindrical shaft.

In some embodiments such a crochet hook or knitting needle as provided herein further comprises a reset button configured to reset the counting system to a point of origin by sending an electrical signal to the electronic display upon an activation of the reset button. In some embodiments such a crochet hook or knitting needle as provided herein further comprises an accelerometer configured to detect a motion, wherein upon detecting a motion the accelerometer is configured to advance the counting system by sending an electrical signal to the display, speaker or tactile signal device. In some embodiments such a crochet hook or knitting needle as provided herein further comprises an optical device configured to optically capture data and transfer it to a computer, wherein the computer is configured to process the captured data and transmit it to the display, speaker or tactile signal device. In some embodiments such a crochet hook or knitting needle as provided herein further comprises a wireless receiver configured to receive data, wherein the wireless receiver is configured to receive data wirelessly and transfer it to a computer, wherein the computer is configured to process the data and transmit it to the display, speaker or tactile signal device. In some embodiments such a crochet hook or knitting needle as provided herein further comprises a wireless receiver configured to transmit data, wherein the wireless receiver is configured to receive data wirelessly from an external device.

In some embodiments the external device comprises a tablet, computer, phone, smart watch, audio device or display device. In some embodiments such a crochet hook or knitting needle as provided herein further comprises a power source, a computer, memory, a receiver or transmitter, a display, an accelerometer, an external device, a speaker or a tactile signal device, wherein the power source, computer, memory, receiver or transmitter, display, accelerometer, external device, speaker or tactile signal device are interconnected with one another. In some embodiments such a crochet hook or knitting needle as provided herein further comprises a computer program product comprising computer executable instructions embodied in a computer readable medium for performing steps comprising receiving an electrical signal from the button, accelerometer or external device, processing the electrical signal to calculate data to advance the counting system, and relaying the data to the electronic display, speaker or tactile signal device.

In some embodiments such a crochet hook or knitting needle as provided herein further comprises an additional knitting needle, wherein the additional knitting needle comprises a cylindrical shaft having a first end and a second end, wherein the first end comprises a point, and wherein the second end comprises a blunt end or a second point.

Provided herein in some embodiments is a crochet hook or knitting needle with an integrated electronic counting system, comprising a cylindrical shaft comprising a first end and a second end, wherein the first end comprises a hook or point, and wherein the second end comprises a blunt end, and an electronic counting system integrated into the cylindrical shaft, the counting system comprising an electronic display configured to display a series of symbols, wherein the series of symbols comprises one or more of letters, numbers, characters or pictures, a button in electrical communication with the electronic display and configured to advance the counting system by sending an electrical signal to the electronic display upon an activation of the buttons, a reset button configured to reset the counting system by sending an electrical signal to the electronic display upon an activation of the reset button, an accelerometer configured to detect a motion, wherein upon detecting a motion the accelerometer is configured to advance the counting system by sending an electrical signal to the display, an integrated computer in communication with the electronic display, button, reset button, and accelerometer, and a computer program product comprising computer executable instructions embodied in a computer readable medium for performing steps comprising receiving an electrical signal from the button, accelerometer or both, processing the electrical signal to calculate data to advance the counting system, relaying the data to the electronic display, and interpreting a signal that translates to a pattern or a set of instructions, wherein the counting system is integrated into the cylindrical shaft of the crochet hook or knitting needle. In some embodiments such a crochet hook or knitting needle as provided herein further comprises an optical device configured to optically capture data and transfer it to a computer, wherein the computer is configured to process the captured data and transmit it to the display or a speaker, tactile signal device or an external device. In some embodiments such a crochet hook or knitting needle as provided herein further comprises a wireless receiver or transmitter configured to receive or send data wirelessly. In some embodiments such a crochet hook or knitting needle as provided herein further comprises a speaker configured to relay audible information or instructions to the user. In some embodiments such a crochet hook or knitting needle as provided herein further comprises a tactile signal device configured to move or create a motion or vibration of the shaft such that the user can be apprised or the pattern or instructions for crocheting or knitting. In some embodiments such a crochet hook or knitting needle as provided herein further comprises a port or receptacle on the shaft to accept a hard wire for the transfer of power or information to or from an external device or power source.

In some embodiments provided herein is a knitting system comprising a knitting needle and a second knitting needle comprising a cylindrical shaft having a point at a first end and a blunt end at a second end.

An object of the presently disclosed subject matter having been stated hereinabove, and which is achieved in whole or in part by the presently disclosed subject matter, other objects will become evident as the description proceeds when taken in connection with the accompanying Examples as best described hereinbelow.

BRIEF DESCRIPTION OF THE DRAWINGS

The presently disclosed subject matter can be better understood by referring to the following figures. The components in the figures are not necessarily to scale, emphasis instead being placed upon illustrating the principles of the presently disclosed subject matter (often schematically). In the figures, like reference numerals designate corresponding parts throughout the different views. A further understanding of the presently disclosed subject matter can be obtained by reference to an embodiment set forth in the illustrations of the accompanying drawings. Although the illustrated embodiment is merely exemplary of systems for carrying out the presently disclosed subject matter, both the organization and method of operation of the presently disclosed subject matter, in general, together with further objectives and advantages thereof, may be more easily understood by reference to the drawings and the following description. The drawings are not intended to limit the scope of this presently disclosed subject matter, which is set forth with particularity in the claims as appended or as subsequently amended, but merely to clarify and exemplify the presently disclosed subject matter.

For a more complete understanding of the presently disclosed subject matter, reference is now made to the following drawings in which.

DETAILED DESCRIPTION

Figure 1A:
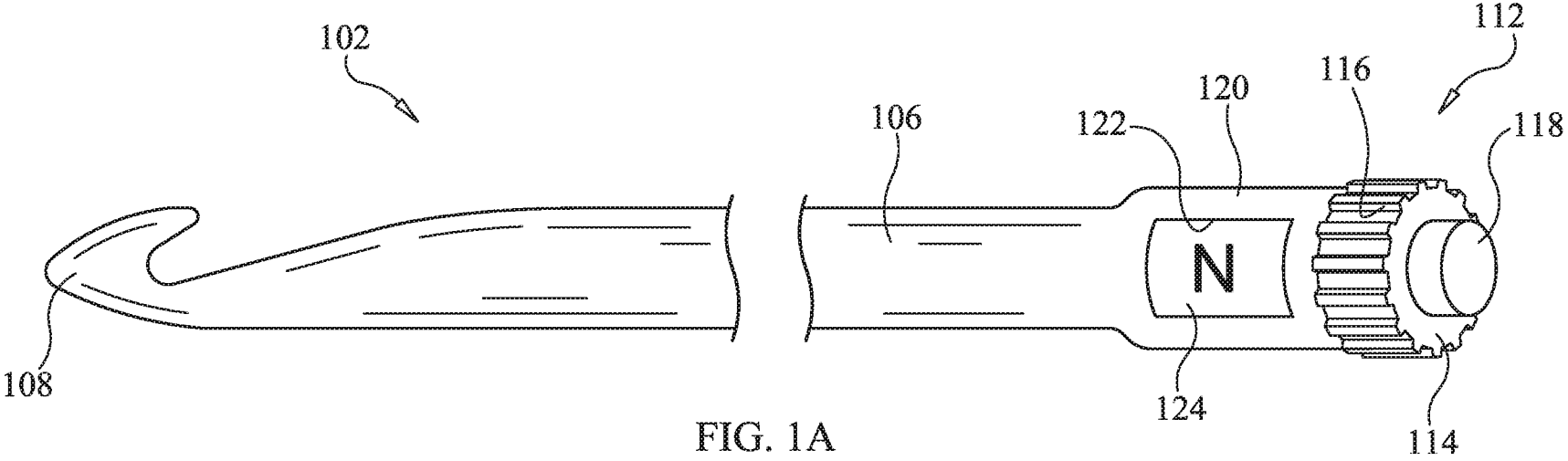
FIGS. 1A and 1B are perspective views of an embodiment of a crochet hook (FIG. 1A) and knitting needle (FIG. 1B) as disclosed herein.

The presently disclosed subject matter now will be described more fully hereinafter, in which some, but not all embodiments of the presently disclosed subject matter are described. Indeed, the presently disclosed subject matter can be embodied in many different forms and should not be construed as limited to the embodiments set forth herein; rather, these embodiments are provided so that this disclosure will satisfy applicable legal requirements.

While the following terms are believed to be well understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter belongs. Although any methods, devices, systems and materials similar or equivalent to those described herein can be used in the practice or testing of the presently disclosed subject matter, representative methods, devices, systems and materials are now described.

Following long-standing patent law convention, the terms "a" and "an" mean "one or more" when used in this application, including the claims.

Unless otherwise indicated, all numbers expressing quantities, units of measure, and so forth used in the specification and claims are to be understood as being modified in all instances by the term "about". Accordingly, unless indicated to the contrary, the numerical parameters set forth in this specification and attached claims are approximations that can vary depending upon the desired properties sought to be obtained by the presently disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to the disclosed devices, systems and methods.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

The term "comprising", which is synonymous with "including," "containing," or "characterized by" is inclusive or open-ended and does not exclude additional, unrecited elements or method steps. "Comprising" is a term of art used in claim language which means that the named elements are present, but other elements can be added and still form a construct or method within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

The following detailed description is merely exemplary in nature and is not intended to limit the described embodiments of the application and uses of the described-embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As a preliminary matter it is noted that at least one difference between crochet and knitting is that an end user can in some embodiments use one crochet hook to form a stitch whereas at least two knitting needles are in some embodiments used in order to form a stitch. Thus, in some embodiments a single crochet hook can be provided while in some embodiments one, two or more knitting needles can be provided as part of a device, system or method.

The presently disclosed subject matter pertains to hooks and needles that are adapted to crochet or knit various kinds of articles by hand, but more particularly articles in which the stitches vary within the rows/rounds as they are formed with the hook or on the needles. Sets of stitches completed in a prescribed order create patterns. It is, therefore, imperative to maintain count of the stitches and the row/round number that corresponds to a particular set of stitches for the pattern to be created and maintained. Additionally, when the stitches in the different rows/rounds are added, varied, or reduced to adjust the shape of an item, it is necessary to keep count of the stitches and the row/round number in order that the proper shape of the article is made.

Stitched patterns are developed during the article's progress by varying, adding, or subtracting stitches in each row/round. Keeping current count of the stitches and the row/round can be done by using memory or counting mentally or by maintaining the count physically by some other means. Depending on memory and mental capability to count may become confusing, tedious, and tiring. Using a physical device for counting is more reliable and less stressful, but currently requires the user to set the work-in-progress aside to free his/her hand(s) to manipulate the counter device or to make a tally mark.

As knitting or crocheting proceeds using ordinary crochet hooks or knitting needles, a user often needs to implement three separate and different tools: 1) a crochet hook or a set of knitting needles, 2) a counting device to keep track of stitches, rows or rounds, and 3) instructions. By combining the functions of each of these components into an integrated system or device, a user can more easily crochet or knit while keeping an accurate count and location in a pattern. Such benefits and features are provided by the presently disclosed subject matter.

In some embodiments crochet hooks can be made of wood, plastic, metal, glass, or ivory. Each hook can have a straight, rod-shaped shaft that tapers to a dull hooked point at one end and blunt opposite end. They can be used singularly and in some embodiments have a length of about 14 to about 38 cm, in some embodiments about 20 to about 30 cm, or about 25 to about 35 cm, with a diameter of about 0.6 to about 25 mm, in some embodiments about 1 to about 20 mm, or about 5 to about 15 mm. The diameter of the hook combined with the bulk and texture of the yarn can in some embodiments determine the size or gauge of the stitches.

In some embodiments knitting needles can be made of wood, plastic, metal, glass, or ivory. Each needle can have a straight, rod-shaped shaft that tapers to a dull point at the one end and has a knob or cap at the opposite blunt end. Such knitting needles can be used in pairs and can in some embodiments be about 25 to about 38 cm in length with a diameter from about 0.6 to about 25 mm. The lengths of the needles can in some embodiments be chosen to accommodate the bulk of the yarn and the required number of stitches for each row as per knitting instructions being followed. The diameter of the needles combined with the bulk and texture of the yarn can be used to determine the size or gauge of the stitches.

In some embodiments knitting needles have ends that terminate the shaft at each end with duplicate points. These double pointed needles are generally used in sets of 4 or 5 and are usually about 18 to about 20 cm in length with diameters about 0.6 to about 25 mm.

In some embodiments knitting needles have a pointed end and a tapered end and pairs of needles are connected to each other by a cord, wire or cable attached to and connecting the tapered ends. Circular knitting needles are usually about 7 to about 15 cm in length with diameters of about 0.6 to about 25 mm and cords, wires or cables that are about 12 to about 137 cm in length.

Currently available counting devices used to maintain count of crocheted or knitted stitch, row or round numbers that correspond to a particular pattern include tools that are separate from the needles or hooks and require manual manipulation by the user to cause the count to move forward. Often times a user must advance the count by depressing a button or twisting a grip. Either method of manipulation used on the device to advance the count to the next number requires that the user remove his/her hand(s) from the hook or needles. The user must then reposition his/her hand(s) on the hook or needles and yarn to continue to crochet or knit. Such inefficient and disruptive actions are eliminated or substantially improved by the disclosed devices and systems.

Crocheting and/or knitting instructions, provided in some embodiments in electronic or hard copy forms, can in some embodiments be written in shorthand using widely accepted abbreviations. For example, in instructions for crocheted articles ch 1, dc 2 represent chain one stitch, double crochet two stitches and instructs the user how to manipulate the yarn and hook to create the required stitches. In the same way, instructions for knitted articles k1, p2 represent knit one stitch, purl two stitches, and instructs the user how to manipulate the yarn and needles to create the required stitches.

The crocheting and/or knitting counting or tracking devices disclosed herein comprise multiple advantages and advancements over current systems. Particularly, existing counting or tracking devices for crochet hooks and knitting needles are manufactured as separate tools or are of complicated construction that makes them expensive. Moreover some are not configured to fit on all diameters of all crochet hooks and knitting needles, or require the use of both hands to manipulate the counter and force the user to drop his/her work-in-progress, advance the counter, then reestablish the position of hands, yarn, and hook/needles. These and other benefits are provided by the disclosed devices, systems and methods that simplify the processes of hand crocheting or knitting and make them easier.

Figure 1B:
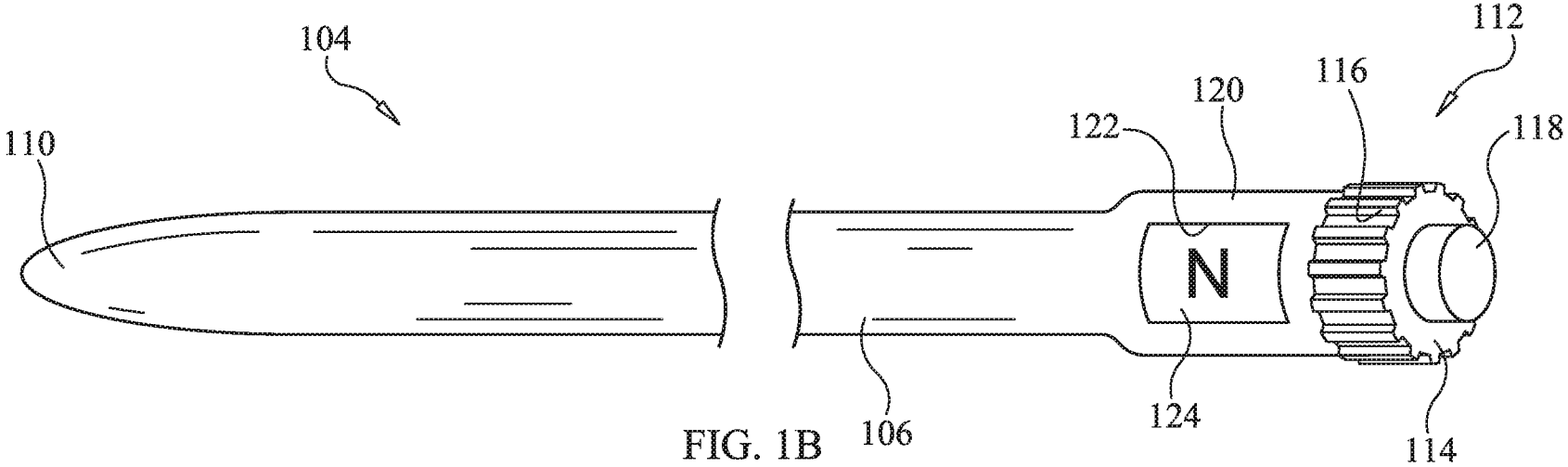

In some embodiments, and as depicted in FIGS. 1A and 1B, a crochet hook 102 (FIG. 1A) or knitting needle 104 (FIG. 1B) provided herein can comprise a cylindrical shaft 106 having a length of about 25 to about 36 cm with a diameter of about 0.6 to about 25 mm. Shaft 106 can be made of wood, plastic, metal, glass, ivory or any other suitable organic or inorganic material. As depicted in FIG. 1A, crochet hook 102 can comprise a shaft 106 that terminates at one end with a hook or hooked end 108, and a second or opposing end can terminate as a blunt or non-pointed end (in FIG. 1A the blunt end is inside counting device 112). As depicted in FIG. 1B, knitting needle 104 can comprise a shaft 106 that terminates at one end with a point or pointed end 110, and a second or opposing end can terminate as a blunt or non-pointed end (in FIG. 1B the blunt end is inside counting device 112).

Continuing with FIGS. 1A and 1B, a crochet hook 102 (FIG. 1A) or knitting needle 104 (FIG. 1B) provided herein can be configured to be easily manipulated by a user to keep count of the stitches, rows or rounds as the knitting or crocheting of an article proceeds, or otherwise keep track of a user's location within a pattern or set of instructions. Such a crochet hook 102 or knitting needle 104 can be configured with an integrated counting device 112 at the blunt end of the crochet hook 102 or knitting needle 104. The blunt end can be an end opposite the hooked end 108 or pointed end 110 of shaft 106. Counting device 112 can in some embodiments comprise a rotatable member 124 encased in a housing 120. Housing 120 can comprise a sleeve or cylindrical structure having a diameter slightly larger than the diameter of rotatable member 124 such that rotatable member 124 can reside and rotate freely within housing 120. Along with containing rotatable member 124 housing 120 can act as a protective casing. Rotatable member 124 can further be characterized as an enumerated spiraling coil or numbered dial housed within housing 120. In some embodiments housing 120 is a continuation of shaft 106.

Rotatable member 124 can in some embodiments have consecutive numbers N (or letters, characters, pictures, or other symbols) inscribed in, printed or embedded thereon that can be viewed through a cutout 122 (or window or transparent portion of shaft 106 and housing 120 surrounding rotatable member 124. Configured in this manner, counting device 112, including number N, can be advanced by a user during the course of crocheting or knitting in order to keep track of stitches, rows or rounds as the crocheting or knitting of an article proceeds. The observable number N can inform the user of the location in a pattern or instructions, such as for example the stitch or row or round currently being crocheted or knitted or the number of stitches or rows or rounds completed.

Continuing with FIGS. 1A and 1B, counting device 112 can in some embodiments comprise grip 114 or knob portion extending from or otherwise mechanically linked to rotatable member 124. Grip 114 can comprise a substantially cylindrical structure making up the blunt end of shaft 106 and providing a terminus of counting device 112. Grip 114 can be integral to rotating member 124 such that the two are a single unitary piece, wherein rotating member 124 is housed within housing 120 while grip 114 extends from and resides outside of housing 120. In some embodiments housing 120 can be affixed to or otherwise attached to shaft 106, such that rotatable member 124, including grip 114, is rotatably engaged to an end (blunt end) of shaft 106. Grip 114 can be configured to transfer a rotational force to rotatable member 124 when gripped and turned or rotated by a user of crochet hook 102 or knitting needle 104. For example, when a user grasps and rotates grip 114 rotatable member 124 correspondingly rotates to reveal the next number N and keeps track of the stitches, rows or rounds as the crocheting or knitting of an article proceeds. In some embodiments grip 114 can comprise one or more ridges 116 or textured members configured to facilitate or enhance a user's grip when rotating or turning grip 114.

Continuing with FIGS. 1A and 1B, in some embodiments counting device 112 comprises a button 118 configured to advance or change number N on rotatable member 124. Button 118 can in some embodiments be configured to rotate rotatable member 124 when button 118 is depressed or pushed inward. In some embodiments button 118 can be mechanically linked to rotatable member 124 and configured to translate a directional movement of button 118, i.e. a directional depression to a rotational movement of rotatable member 124. For example, in some embodiments, a user can depress or push button 118 to thereby turn or rotate rotatable member 124, the result of which is to advance number N. Depending on the crocheting or knitting pattern being completed, a user can depress button 118 or otherwise advance number N after each stitch, row or round. Constructed in this manner, counting device 112 can be advanced when the user taps or pushes button 118 against a firm surface. The user can continue to maintain a grip on the hook 102 or needles 104 and yarn without having to reposition the hand(s), which allows for seamless and continuous crocheting or knitting. In some embodiments number N can be reversed, reset or returned to the point of origin by turning grip 114 and/or by depressing button 118.

In some embodiments, a crochet hook 102 and/or knitting needle 104 as depicted in FIGS. 1A and 1B can comprise a counting device 112 comprising both a knob 114 for advancing a rotatable member 124 and a button 118 for advancing a number N on rotatable member 124. In such a configuration either or both the knob 114 and button 118 can be used to advance the rotatable member 124. Alternatively, in some embodiments a crochet hook 102 and/or knitting needle 104 can have either a knob 114 for advancing rotatable member 124 or a button 118 for advancing a number N on rotatable member 124. In some embodiments number N can be reversed, reset or returned to the point of by turning grip 114 and/or depressing button 118.

Thus, in some embodiments provided herein is a crochet hook or knitting needle with an integrated counting device, comprising a cylindrical shaft comprising a first end and a second end, wherein the first end comprises a hook or point, and wherein the second end comprises a blunt end, and a counting device integrated into the cylindrical shaft. The counting device can comprise a rotatable member encased in a housing, wherein the rotatable member can rotate within the housing, a series of symbols on a surface of the rotatable member, an opening in or transparent portion of the housing through which at least one of the symbols in the series of symbols can be viewed, and an advancing member configured to rotate the rotatable member such that a viewable symbol in the opening or transparent portion of the housing is advanced to the next symbol in the series of symbols, wherein the counting device is integrated into the cylindrical shaft of the crochet hook or knitting needle.

In such a configuration the cylindrical shaft can have a length of about 7 to about 38 cm, and a diameter of about 0.6 to about 25 mm, and the cylindrical shaft and counter can be made of wood, plastic, metal, glass or ivory or any suitable organic or inorganic material.

In such a configuration the advancing member can comprise a knob portion mechanically linked to rotatable member, wherein the application of a rotational force to the knob results in a transfer of the rotational force to rotatable member to thereby advance the next symbol in the series of symbols or to reset the rotatable member to the point of origin. In some aspects the advancing member can comprise a depressible button mechanically linked to rotatable member, wherein the depressible button is configured to translate a directional movement of the button to a rotational movement of the rotatable member to thereby advance the next symbol in the series of symbols or to reset the rotatable member to the point of origin. The advancing member can comprise a knob portion mechanically linked to rotatable member, wherein the application of a rotational force to the knob results in a transfer of the rotational force to rotatable member to thereby advance the next symbol in the series of symbols, and wherein the advancing member comprises a depressible button mechanically linked to rotatable member, wherein the depressible button is configured to translate a directional movement of the button to a rotational movement of the rotatable member to thereby advance the next symbol in the series of symbols or to reset the rotatable member to the point of origin.

Figure 2A:
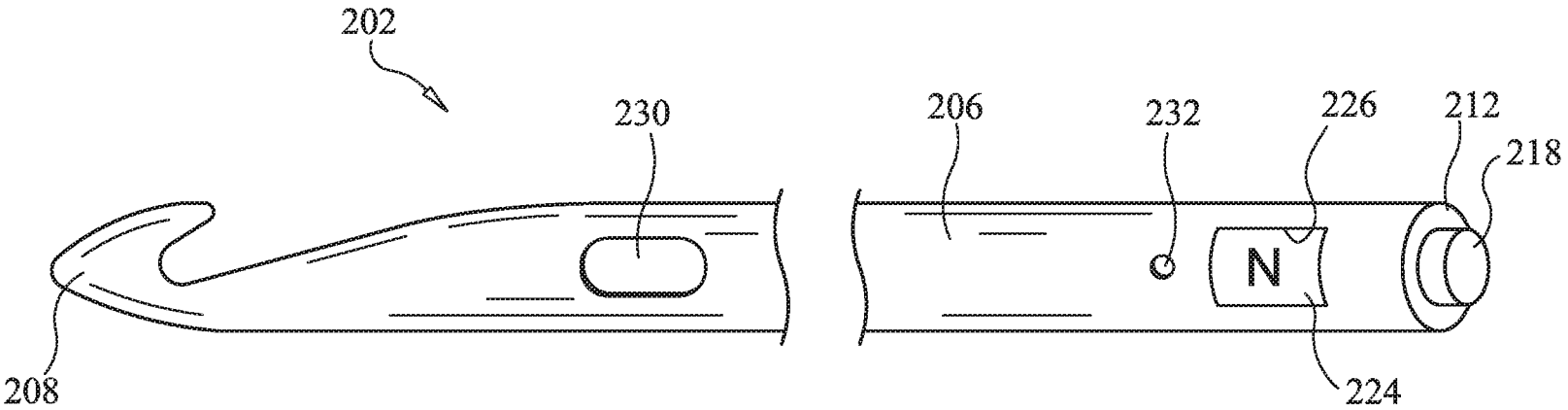
FIGS. 2A and 2B are perspective views of an embodiment of a crochet hook (FIG. 2A) and knitting needle (FIG. 2B) as disclosed herein.
Figure 2B:
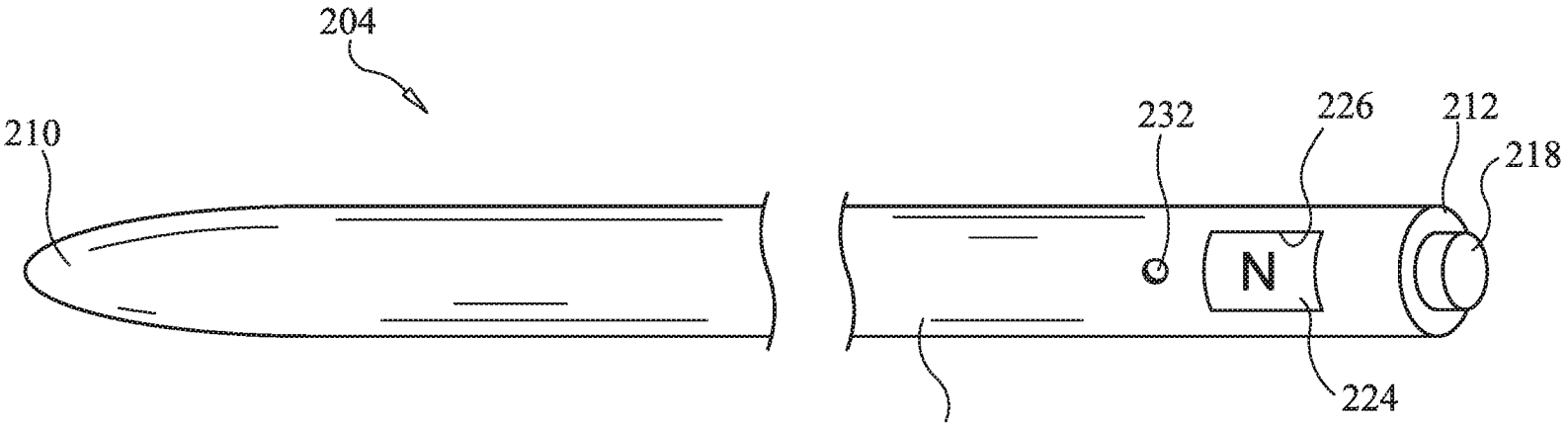

Turning now to FIGS. 2A and 2B, in some embodiments a crochet hook 202 (FIG. 2A) and/or knitting needle 204 (FIG. 2B) provided herein can comprise a cylindrical shaft 206 having a length of about 14 to about 38 cm, and a diameter ranging from about 0.6 to about 25 mm. Crochet hook 202 and knitting needle 204 can be made of wood, plastic, metal, glass, ivory or any other suitable organic or inorganic material. As depicted in FIG. 2A, crochet hook 202 can comprise a shaft 206 that terminates at one end with a hook or hooked end 208, and a second or opposing end that can terminate as a blunt end 212 or non-hooked end. As depicted in FIG. 2B, knitting needle 204 can comprise a shaft 206 that terminates at one end with a point or pointed end 210, and a second or opposing end that can terminate as a blunt end 212 or non-pointed end. Blunt end 212 can be an end opposite the hooked end 208 or pointed end 210 of shaft 206.

Continuing with FIGS. 2A and 2B, a crochet hook 202 (FIG. 2A) or knitting needle 204 (FIG. 2B) provided herein can be configured to be easily manipulated by a user to keep count of the stitches, rows or rounds as the crocheting or knitting of an article proceeds, or otherwise keep track of a user's location within a pattern or set of instructions. Such a crochet hook 202 or knitting needle 204 can be configured with an integrated counting system comprising in some embodiments a button and/or buttons to activate and/or advance a counter.

For example, and as illustrated in FIGS. 2A and 2B, crochet hook 202 and knitting needle 204 can comprise a button 218. Button 218 can be configured to be depressible by a user to advance or activate a counting system, such as for example by sending an electrical impulse or signal to display 224. Display 224 can indicate consecutive numbers N, symbols, characters and/or pictures that can be viewed by a user through a cutout or window 226 in or a transparent portion of shaft 206. Constructed in this manner, counting device 212 can be advanced when the user taps or pushes button 218 against a firm surface and the user can continue to maintain a grip on the crochet hook 202 or knitting needle 204 and yarn, while repositioning of hands to continue crocheting or knitting will no longer be required.

In some embodiments, a second button 230 can be located just below a finger grip area on shaft 206 of crochet hook 202, i.e. an area that is located about mid-shaft of shaft 206 on crochet hook 202. Button 230 can be configured to be depressible by a user to advance or activate a counting system such as for example, by sending an electrical impulse or signal to display 224. Display 224 can indicate consecutive numbers N (or letters, characters, pictures or other symbols) that can be viewed by a user through a cutout or window 226 in or a transparent portion of shaft 206. Constructed in this manner, the counter can be advanced when a user depresses button 230 on shaft 206 and the user can continue to maintain a grip on the crochet hook 202 and yarn, while repositioning of hands to continue crocheting will no longer be required.

In some embodiments, a crochet hook 202 as depicted in FIGS. 2A and 2B, respectively, can comprise a counting system comprising both a first button 218 and second button 230 on shaft 206, either or both of which can advance a number N on display 224. Alternatively, in some embodiments a crochet hook 202 can have a first button 218, a second button 230.

In some embodiments crochet hook 202 or knitting needle 204 can further comprise a reset button 232, as depicted in FIGS. 2A and 2B. Reset button 232 can comprise a small depressible button located somewhere along shaft 206, such as for example near display 224. Thus, depressing reset button 232 can reset or return the count back to the point of origin. Reset button 232 can in some embodiments be in communication with display 224.

Display 224 can be configured to display consecutive numbers N (or letters, characters, pictures or other symbols) using a back-lit display, LED lights or other display means through cut-out 226 in shaft 206. Configured in this manner, a user can advance number N during the course of crocheting or knitting in order to keep track of stitches, rows or rounds as the crocheting or knitting of an article proceeds. The observable number N can inform the user of the location in a pattern or instructions, such as for example the stitch, row or round currently being crocheted or knitted. Alternatively, in some embodiments display 224 can be housed within shaft 206 that is comprised of a clear or opaque material, or a portion having a clear or opaque area, through which display 224 can be viewed.

Figure 3A:
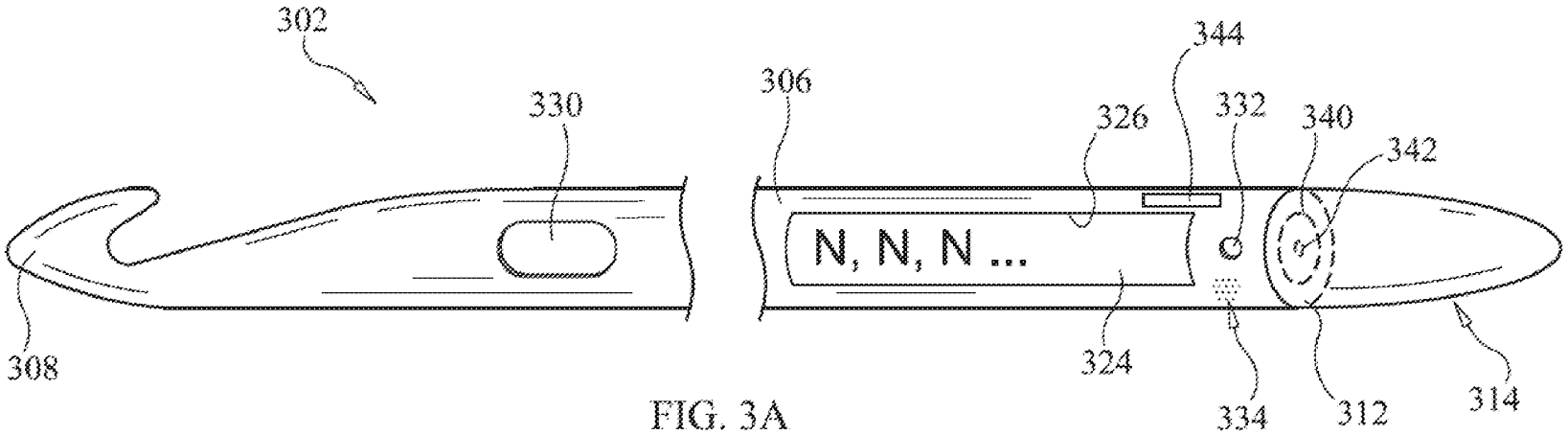
FIGS. 3A and 3B are perspective views of an embodiment of a crochet hook (FIG. 3A) and knitting needle (FIG. 3B) as disclosed herein.
Figure 3B:
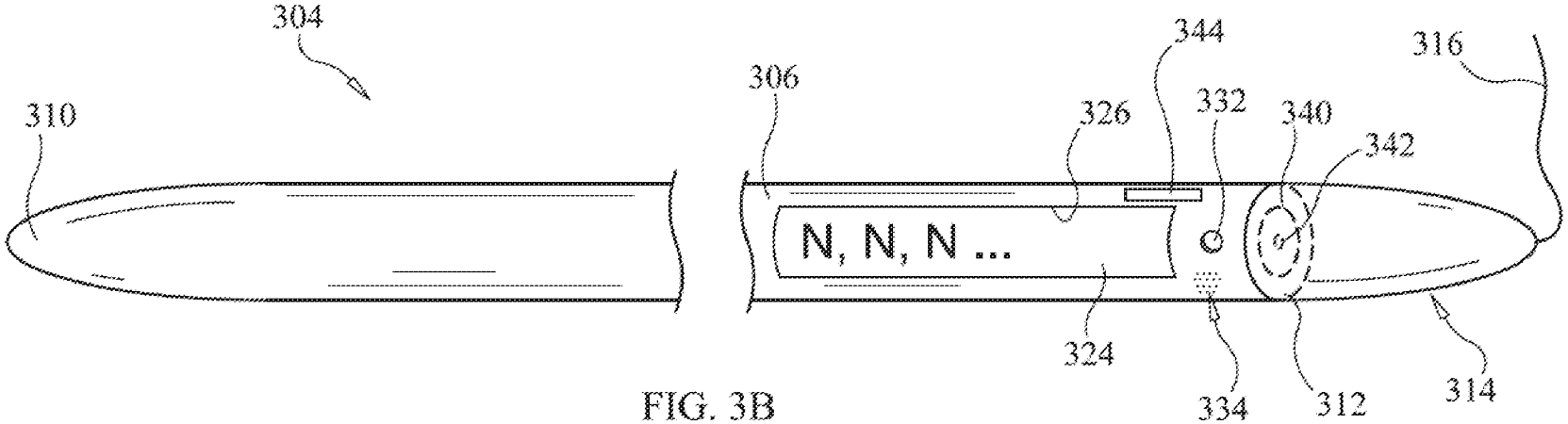

Turning now to FIGS. 3A and 3B, in some embodiments a crochet hook 302 (FIG. 3A) and/or knitting needle 304 (FIG. 3B) provided herein can comprise a cylindrical shaft 306 having a length of about 7 to about 38 cm, and a diameter ranging from about 0.6 mm to about 25 mm. Crochet hook 302 and knitting needle 304 can be made of wood, plastic, metal, glass, ivory or any other suitable organic or inorganic material. As depicted in FIG. 3A, crochet hook 302 can comprise a shaft 306 that terminates at one end with a hook or hooked end 308, and a second or opposing end that can terminate as a blunt end 312 or non-hooked end. As depicted in FIG. 3B, knitting needle 304 can comprise a shaft 306 that terminates at one end with a point or pointed end 310, and a second or opposing end that can terminate as a blunt end 312 or non-pointed end. Blunt end 312 can be opposite the hooked end 308 or pointed end 310 of shaft 306. Blunt end 312 can attach to end cap 314. End cap 314 can be a protective cap for blunt end 312, can attach to blunt end 312 of needle 304 and form a second terminating end that has the same or similar design dimensions as point 310, or can be connected by a wire, cable or cord 316 that is attached to a second end cap 314 so cord 316 connects a pair of end caps 214 that can attach to blunt end 312 and connect a pair of knitting needles 204. Reset button 332, button/sensor 330, and/or speaker 334 can be located along shaft 306. Receptacle/port 344 and camera 342 can be located along shaft 306 or at blunt end 312.

Continuing with FIGS. 3A and 3B, a crochet hook 302 (FIG. 3A) or knitting needle 304 (FIG. 3B) provided herein can be configured to be easily manipulated by a user to keep count of the stitches, rows or rounds as the crocheting or knitting of an article proceeds, or otherwise keep track of a user's location within a pattern or set of instructions. Such a crochet hook 302 or knitting needle 304 can be configured with an integrated counting system comprising in some embodiments a button or sensor to be activated by a user or for example by an object covering it or passing over it to advance a counter and/or in some embodiments an accelerometer or other sensor configured to detect a designated movement or signal to thereby advance a counter. The user can be apprised of the advance of the counter through a display, by an audio signal, by kinesthetic means (such as a motion or vibration) and/or by communication with an external device (such as but not limited to a computer, tablet, phone, watch, speaker, receiver, and/or transmitter).

For example, and as illustrated in FIGS. 3A and 3B, crochet hook 302 and knitting needle 304 can comprise a button/sensor 330 that can be configured to be activated by a user to advance a counting system, such as for example by sending an electrical impulse or signal to display 324, speaker 334, tactile signal device 436 (see FIG. 4) and/or to an external device. Display 324, speaker 334 and/or tactile signal device 436 (see FIG. 4) can indicate consecutive numbers N, symbols, characters, pictures and/or video that can be viewed by a user through a cutout or window 326 in and/or through a transparent portion of shaft 306, heard by a user through speaker 334 in shaft 306, felt by a user with for example a vibration within shaft 306, and/or communicated to the user by way of an external device. Constructed in this manner, the counter can be advanced when a user activates button/sensor 330 on shaft 306 or makes a designated movement of hook 302 or needle 304 and the user will be able to detect the advancement of number N as indicated by display 324, speaker 334, tactile signal device 436 (see FIG. 4) and/or by means of an external communication device.

Button/sensor 330 can in some embodiments be located anywhere along the length of shaft 306. In some embodiments, button/sensor 330 can be located just below a finger grip area on shaft 306, i.e. an area that is located about mid-shaft of shaft 306 on crochet hook 302. The user can activate button/sensor 330 and continue to maintain a grip on the crochet hook 302 and yarn so repositioning of hands to continue crocheting will no longer be required.

In some embodiments button/sensor 330 can be located near hook 308 or point 310 and activated when yarn or another object covers it and/or crosses over it so the user can continue to maintain a grip on crochet hook 302 or needle 304 and yarn so repositioning of hands to continue crocheting or knitting will no longer be required.

In some embodiments crochet hook 302 or knitting needle 304 can further comprise a reset button 332, as depicted in FIGS. 3A and 3B. Reset button 332 can comprise a small button/sensor located somewhere along shaft 306, such as for example near display 324. Thus, resetting or turning back the count to the point of origin can be done by activating reset button 332. Reset button 332 can in some embodiments be in communication with display 324, speaker 334, tactile signal device 436 (see FIG. 4) or an external device (such as but not limited to a computer, tablet, phone, watch, speaker, receiver, and/or transmitter).

Figure 4:
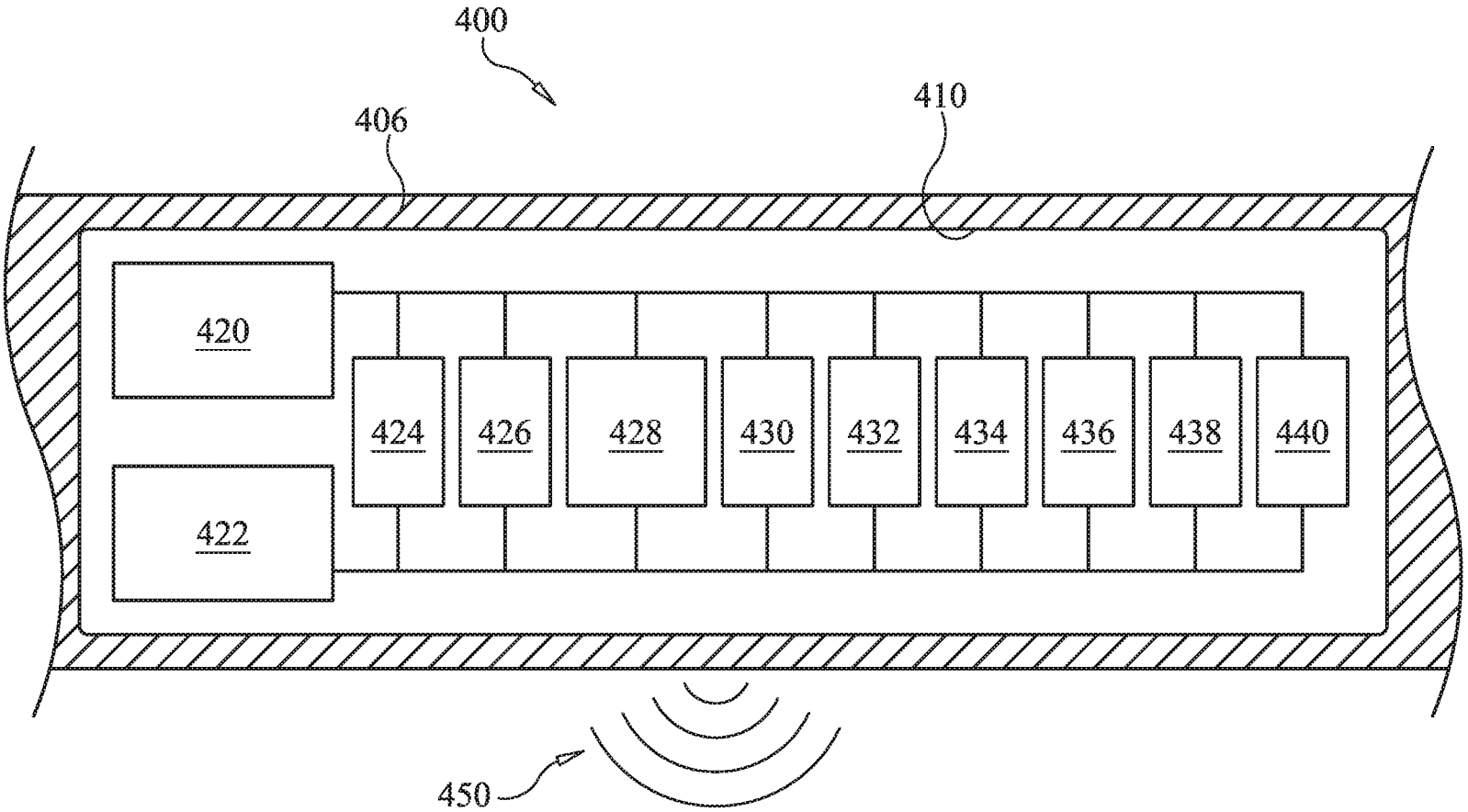
FIG. 4 is a cross-sectional view of a portion of a crochet hook and/or knitting needle as disclosed herein.

In some embodiments crochet hook 302 or knitting needle 304 can further comprise an accelerometer or motion detection device 430 (as depicted in FIG. 4) such that when the user makes a pre-determined motion with hook 302 or needle 304, a signal will be sent that can advance a number N on display 324, create a sound through speaker 334, create a motion of tactile signal device 436 (see FIG. 4) that can be felt through shaft 306, and/or signal an external device. Thus, the user can apply a designated motion to hook 302 or needle 304 to activate accelerometer 430 (see FIG. 4) that will send a signal to display 324, speaker 334, tactile signal device 436 (See FIG. 4), and/or an external device (such as but not limited to a computer, tablet, phone, watch, speaker, receiver, and/or transmitter). Constructed in this manner, the counter can be advanced when a user makes a designated movement of hook 302 or needle 304 that activates accelerometer 430 (see FIG. 4) within shaft 306 and the user will be able to detect the advancement of number N as indicated by display 324, speaker 334, tactile signal device 436 (see FIG. 4) and/or by means of an external communication device and the user can continue to maintain a grip on the hook 302 or needle 304 and yarn so repositioning of hands to continue crocheting or knitting will no longer be required and the user can keep count of the stitches, rows or rounds as the crocheting or knitting of an article proceeds, or otherwise keep track of a location within a pattern or set of instructions.

In some embodiments, a crochet hook 302 and/or knitting needle 304 as depicted in FIGS. 3A and 3B, respectively, can comprise a counting system comprising a button/sensor 330 on shaft 306, a reset button 332 and/or an accelerometer 430 (see FIG. 4), one or all of which can advance a number N on display 324, initiate a sound through speaker 334, initiate a motion of tactile signal device 436 (see FIG. 4) that can be felt through shaft 306, and/or activate an external device. Alternatively, in some embodiments a crochet hook 202 and/or knitting needle 304 can have either/all button/sensor 330, reset button 332, and/or accelerometer 430 (see FIG. 4).

Display 324 can be configured to display consecutive numbers N (or letters, symbols, characters, pictures, and/or video) using a back-lit display, LED lights or other display means through cut-out 326 in shaft 306. Alternatively, in some embodiments display 324 can be housed within shaft 306 that is comprised of a clear or opaque material, or a portion having a clear or opaque area, through which display 324 can be viewed. Configured in this manner, a user can advance number N during the course of crocheting or knitting in order to keep track of stitches, rows or rounds as the crocheting or knitting of an article proceeds. The observable number N can inform the user of the location in a pattern or instructions, such as for example the stitch, row or round currently being crocheted or knitted.

Speaker 334 can be configured to indicate consecutive numbers N (or letters, characters, pictures or other symbols) using sounds. Configured in this manner, a user can hear a sound representing number N during the course of crocheting or knitting in order to keep track of stitches, rows or rounds as the crocheting or knitting of an article proceeds. The audible sound indicating number N can inform the user of the location in a pattern or instructions, such as for example the stitch, row or round currently being crocheted or knitted.

Tactile signaling device 436 (see FIG. 4) can be configured to indicate consecutive numbers N (or letters, characters, pictures or other symbols) using motions or vibrations. Configured in this manner, a user can feel a motion representing number N during the course of crocheting or knitting in order to keep track of stitches, rows or rounds as the crocheting or knitting of an article proceeds. The kinesthetic motion indicating number N can inform the user of the location in a pattern or instructions, such as for example the stitch, row or round currently being crocheted or knitted.

In some embodiments end cap 314 can be attached to blunt end 312. End cap 314 can have a blunt shape to protect and/or prevent the accidental use of optical device 340.

In some embodiments end cap 314 can be shaped to duplicate knitting needle point 310 so needles 314 can to be used as double pointed knitting needles.

In some embodiments a pair of end caps 314 can be connected by a wire, cable or cord 316 so the pair of end caps 314 can connect a pair of knitting needles 314 to be used as circular needles.

In some embodiments, crochet hook 302 and/or knitting needle 304 can further comprise an optical device 340, such as for example a camera. Optical device 340 can comprise a lens 342 and can be located at any portion of shaft 306 or at blunt end 312, as illustrated for example in FIGS. 3A and 3B. Optical device 340 can be configured as a camera, quick code (q code) reader or bar code reader, such that it can read/detect information and transfer it to an internal and/or external computer or central processor. Such a configuration can allow crochet hook 302 and/or knitting needle 304 and/or an external device to detect and/or read an instruction set for a crocheting and/or knitting pattern and then relay the information to the user through display 324, speaker 346, textile signal device 436 (see FIG. 4), and/or and external device (such as but not limited to a computer, tablet, phone, watch, speaker, receiver, and/or transmitter). In some embodiments such instructions or patterns, e.g., k1, p2, k1 . . . or 1 dc, 2dc, 1 dc . . . , can be temporarily stored on internal data storage, processed and then relayed to display 324, speaker 346, textile signal device 436 (See FIG. 4), and/or and external device (such as but not limited to a computer, tablet, phone, watch, speaker, receiver, and/or transmitter) in a real-time manner as a user is completing the pattern.

In some embodiments the instructions or patterns can be stored in an external device such as but not limited to a computer, tablet, watch or phone and relayed to hook 302 or needle 304 and can activate display 324, speaker 346 and/or textile signal device 436 (See FIG. 4). In some embodiments, an internal microchip can translate the instructions or code before sending the information to display 324, speaker 346, textile signal device 436 (see FIG. 4), and/or an external device. Constructed in this manner, hook 302 or needle 304 can be programmed with a set of stitch-by-stitch/row-by-row/round-by-round instructions that can be viewed on display 324, heard through speaker 346, or felt by the motion within shaft 306, or by communication with an external device and the count can be advanced when the user flicks hook 302 or needle 304 and/or triggers button/signal 330. The user can continue to maintain a grip on the hook/needles and yarn and repositioning of hands to continue crocheting or knitting will no longer be required.

In some embodiments hook 302 and needle 304 can have a receptacle/port 334 that can be located at any portion of shaft 306 or at blunt end 312, as illustrated for example in FIGS. 3A and 3B that will accept a hard wire for the transfer of power and/or information between hook 302 or needle 304, an external device and/or power source.

In some embodiments, crochet hook 302 and/or knitting needle 304 can further comprise a wireless receiver and/or transmitter configured to wirelessly receive and/or transmit data and information. By way of example and not limitation, such wireless forms of communication can comprise Wi-Fi and/or Bluetooth. With integrated wireless communication capabilities crochet hook 302 and/or knitting needle 304 can provide for the transfer of instructions to and/or from an external device (tablet, computer, phone, smart watch) to and/or from display 324, speaker 346, textile signal device 436 (see FIG. 4) of crochet hook 302 and/or knitting needle 304 and/or an external device. For example in some embodiments the wireless receiver and/or transmitter can provide for the transfer from the crochet hook 302 and/or knitting needle 304 of the stitch-by-stitch, row-by-row, and/or round-by-round progress of items-in-progress to an external device and can allow a user to compare a virtual image of an item-in-progress with the actual crocheted or knitted item-in-progress. In some embodiments instructions, information and/or data can be relayed wirelessly to and/or from an external device to and/or from crochet hook 302 and/or knitting needle 304 to inform the user of the location in a pattern or instructions, such as for example the stitch, row or round currently being crocheted or knitted.

In some embodiments, crochet hook 302 and/or knitting needle 304 that comprises a wireless receiver and/or transmitter configured to wirelessly receive and/or transmit data and information can wirelessly communicate with an external device. Such a configuration can cause for example an audio device such as headphones to audibly describe to the user the crocheting or knitting instructions or patterns for an item-in-progress. Constructed in this manner, the wireless capabilities built into a crochet hook 302 and/or knitting needle 304 can for example allow the transfer of instructions to an external device such as but not limited to speakers, headphones, tablet, computer, phone and/or smart watch. Such a configuration can be useful when shaft 106, 206, or 306 of a crochet hook and/or knitting needle are too thin for an embedded display, or an embedded display is not desired.

In some embodiments, crochet hook 302 and/or knitting needle 304 that comprises a wireless receiver and/or transmitter configured to wirelessly receive and/or transmit data and information can wirelessly communicate with an external device. Constructed in this manner, the wireless capabilities built into a crochet hook 302 and/or knitting needle 304 can for example allow the transfer of instructions from an external device, tablet, computer, phone and/or smart watch to the user's eyes via display 324, to the user's ears via speaker 334 and/or to the user's fingers via the vibrations of shaft 306.

In some embodiments wireless capabilities can allow for the transfer of a signal describing a set of stitch-by-stitch/row-by-row/round-by-round instructions that can be felt through the vibration of shaft 306 made by textile signal device 436 (see FIG. 4). For example 1 short vibration can represent knit 1 and 2 long vibrations can represent purl 2. Getting instructions described in this manner can allow a user to continue to maintain a grip on the needles/hook and yarn and repositioning of hands to continue crocheting or knitting a pattern will no longer be required. In some embodiments the audio message can be advanced or started again by activating button/sensor 332 located in hook 302 and/or needle 304.

Turning now to FIG. 4, a cross-sectional view of a crochet hook and/or knitting needle 400 as provided herein is illustrated. The cross-sectional view of crochet hook and/or knitting needle 400 can represent a cross-sectional view of a portion of crochet hook 102, 202, 302 and/or knitting needle 104, 204, 304. To elaborate, FIG. 4 illustrates a cross-sectional view of a portion of shaft 406 (corresponding to shaft 106, 206 and/or 306 of FIGS. 1A, 1B, 2A, 2B, 3A, and/or 3B) and cavity 410. Housed within cavity 410 can in some embodiments be a power source 420, a computer 422, memory 424, wireless receiver/transmitter 426, display interface 428, accelerometer 430, usb/port/wired receptacle 432, speaker 434, textile signal device 436, button/sensor interface 438 and/or camera 440. Each of these components, or a subset thereof, can in some embodiment be interconnected or in electrical communication as depicted in FIG. 4. Each of these components, or a subset thereof, can be housed within an interior space of cavity 410 within the interior of shaft 406. The configuration, orientation or layout of power source 420, computer 422, memory 424, wireless receiver/transmitter 426, display interface 428 accelerometer 430, usb/port/wired receptacle 432, speaker interface 434, textile signal device 436, button/sensor interface 438 and camera 440 in FIG. 4 is exemplary only, and such components, or a portion thereof, can be oriented or configured in any suitable manner.

Computer 422 can be any suitable general-purpose computing platform. Computer 422 can comprise a microprocessor, can be powered by power source 420 (or powered by any other suitable external or internal power source), and can function in coordination with memory 424. Computer 422, and particularly a microprocessor therein, can in some embodiments control functions and operations of crochet hook and/or knitting needle 400, as discussed herein and illustrated in FIGS. 1A, 1B, 2A, 2B, 3A and 3B, in some embodiments by executing instructions stored in memory 424 or in some embodiments activate an external device such as but not limited to a computer, tablet, phone, smart watch, audio device or display device.

The functions and subject matter described herein can in some embodiments be implemented using a computer program product comprising computer executable instructions embodied in a computer readable medium. Such computer readable medium can be stored on memory 424, and implemented by computer 422. Exemplary computer readable media suitable for implementing the subject matter described herein include disk memory devices, chip memory devices, application specific integrated circuits, programmable logic devices, and downloadable electrical signals. In addition, a computer program product that implements the subject matter described herein may be located on a single device or computing platform or may be distributed across multiple devices or computing platforms.

Wireless receiver and/or transmitter 426 can be configured to wirelessly receive and/or transmit data and information via wireless signal 450. By way of example and not limitation, such wireless forms of communication can comprise Wi-Fi and Bluetooth. As discussed herein, with integrated wireless communication capabilities, crochet hook and/or knitting needle 400 can exchange information and/or data, i.e. receive and/or transmit, with another device, such as but not limited to a tablet, computer, phone, smart watch, audio device or display device.

Accelerometer 430, or other motion-sensing device, can in some embodiments work in concert with computer 422, including the microprocessor, in order to sense or detect a motion that is predetermined to indicate a count or location within a pattern. For example, a user can flick, tap or otherwise cause crochet hook and/or knitting needle 400 to move to activate accelerometer 430 to create a signal that will activate a count and advance the counting device. In some embodiments accelerometer 430 can be configured to detect only a predetermined motion to advance a counter, and/or can be configured to be adjustable or programmed by a user to detect a desired motion. Upon detection of a motion accelerometer 430 can transmit an electrical signal or pulse to computer 422 which can then process such signal and advance the counter. Such advancement can then be translated to display interface 428 which can then display number N on display 324 (see FIGS. 3A, 3B), to speaker interface 434 to be heard though speaker 334 (see FIGS. 3A, 3B), to textile signal device 436 to be felt through shaft 306 (see FIGS. 3A, 3B).

Port or receptacle 432 that can be located at any portion of shaft 306 or at blunt end 312 (see FIGS. 3A and 3B) will accept a hard wire for the transfer of power and/or information between hook/needle 400 and an external device and/or power source.

Speaker interface 434 that can activate speaker 334 (see FIGS. 3A, 3B) will relay information and/or instructions between hook/needle 400 and computer 422 and/or an external device.

Tactile signal device 436 that can be located within shaft 406 can be activated upon receipt of a signal from computer 422 and/or an external device will move or create a motion or vibration of shaft 406 such that the user can be apprised of the pattern or instructions for crocheting or knitting. For example tactile signaling device 436 can be configured to indicate consecutive numbers N (or letters, characters, pictures or other symbols) and/or the required stitch using motions or vibrations. For example 1 short vibration can represent knit 1 and 2 long vibrations can represent purl 2. Configured in this manner, a user can feel a motion representing number N and/or pattern instructions during the course of crocheting or knitting in order to keep track of stitches, rows or rounds as the crocheting or knitting of an article proceeds. The kinesthetic motion indicating number N can inform the user of the location in a pattern or instructions, such as for example the stitch, row or round currently being crocheted or knitted.

Thus, as provided herein in some embodiments a crochet hook or knitting needle 400 with an integrated electronic counting system can comprise a cylindrical shaft comprising a first end and a second end, wherein the first end comprises a hook or point, and wherein the second end comprises a blunt end, and an electronic counting system integrated into the cylindrical shaft. The counting system can comprise a button/sensor interface 438 wherein the button/sensor interface 438 is in electrical communication with components of hook/needle 400 by sending an electrical signal to the computer, to the electronic display, to the speaker, to the tactile signal device and/or to an external device and configured to advance the counting system upon activation of button/sensor 230 or 330 (see FIGS. 2A, 3A and 3B), wherein the counting system is integrated into the cylindrical shaft of the crochet hook or knitting needle.

Optical device 440 can comprise a lens 342 and can be located at any portion of shaft 306 or at blunt end 312 (see FIGS. 3A and 3B). Optical device 440 can for example be configured as a camera, quick code (q code) reader and/or bar code reader, such that it can read/detect information and transfer it to an internal computer 422 and/or to an external device. Such a configuration can allow hook/needle 400 and/or an external device to detect and/or read an instruction set for a crocheting and/or knitting pattern and then relay the information to the user through display 324, speaker 346 (see FIGS. 3A and 3B), textile signal device 436 (see FIG. 4), and/or and external device (such as but not limited to a computer, tablet, phone, watch, speaker, receiver, transmitter and/or audio device). In some embodiments such instructions or patterns, e.g., k1, p2, k1 . . . or 1 dc, 2dc, 1 dc . . . , can be temporarily stored on internal memory 424, processed on computer 422 and then relayed to display 324, speaker 346 (see FIGS. 3A and 3B), textile signal device 436, and/or and external device (such as but not limited to a computer, tablet, phone, watch, speaker, receiver, and/or transmitter) in a real-time manner as a user is completing the pattern.

In such a configuration the cylindrical shaft can have a length of about 7 to about 38 cm, and a diameter of about 0.6 mm to about 25 mm, and be made of wood, plastic, metal, glass or ivory or any other suitable organic or inorganic material.

In such a configuration the electronic display can be configured to display a series of symbols, wherein the series of symbols comprises one or more of numbers, letters, characters, pictures and/or video. The electronic display can comprise a light emitting diode (LED), backlit display, or other electronic display.

In some embodiments such a configuration can comprise a button/sensor and/or a second reset button, wherein the first and second buttons are in electrical communication with the electronic display and configured to advance and/or rest the counting system by sending an electrical signal to the electronic display upon an activation of one or both of the first and second buttons. In some aspects one or both of the first and second buttons can be depressible buttons, wherein activation comprises depression of the depressible button and/or wherein activation comprises a signal made by the passing of or contact with an object across the button/sensor. The first button can be located along the length of the cylindrical shaft or at the hooked or pointed end of the shaft, and the second button can be located along the shaft or at the blunt end of the cylindrical shaft. In some embodiments a reset button can be included and can be configured upon activation to reset the counting system by sending an electrical signal to the computer, to the electronic display, to the speaker, to the tactile signal device and/or to an external device.

In some embodiments such a configuration can further comprise an accelerometer configured to detect a motion, wherein upon detecting a motion the accelerometer is configured to advance the counting system by sending an electrical signal to the computer, to the electronic display, to the speaker, to the tactile signal device and/or to an external device. In some embodiments such a configuration can further comprise an optical device configured to optically capture data and transfer it to a computer, wherein the computer is configured to process the captured data and transmit it to the display, to the speaker, to the tactile signal device and/or to an external device. In some embodiments such a configuration can further comprise a wireless receiver/transmitter configured to receive/transfer data, wherein the wireless receiver/transmitter is configured to receive/transfer data wirelessly and receive or transfer it to/from a computer, wherein the computer is configured to process the data and transmit it to the electronic display, to the speaker, to the tactile signal device and/or to an external device. In some embodiments the external device comprises but is not limited to a tablet, computer, phone, smart watch, audio device or display device. In some embodiments such a configuration can further comprise a power source, a computer, memory, a receiver/transmitter, a display, an accelerometer, a usb/port/receptacle, a speaker, a tactile signal device and a camera wherein the power source, computer, memory, receiver/transmitter, display, accelerometer, usb/port/receptacle, speaker and tactile signal device and camera are interconnected with one another.

In some embodiments such a configuration of a crochet hook or knitting needle as provided herein can further comprise a computer program product comprising computer executable instructions embodied in a computer readable medium for performing steps comprising:

(a) receiving an electrical signal from the button/sensor, accelerometer or both;
(b) processing the electrical signal to calculate data to advance the counting system;
(c) relaying the data to the electronic display, to the speaker, to the tactile signal device and/or to an external device;
(d) interpreting a signal that translates to a pattern or a set of instructions.

In some embodiments a knitting needle as described herein with an integrated counting device or counting system can be provided in a set along with a other knitting needles. The additional knitting needle(s) can comprise a cylindrical shaft having a first end and a second end, wherein the first end comprises a point, and wherein the second end comprises a blunt end or point. In other words, the additional knitting needle of the set can be a regular or ordinary knitting needle(s) and need not have an integrated counting device or counting system.

In some embodiments, provided herein is a crochet hook or knitting needle with an integrated electronic counting system, comprising a cylindrical shaft comprising a first end and a second end, wherein the first end comprises a hook or point, and wherein the second end comprises a blunt end, and an electronic counting system integrated into the cylindrical shaft. The counting system in such an embodiment can comprise an electronic display configured to display a series of symbols, wherein the series of symbols comprises one or more of numbers, letters, characters, pictures, or video and, a button in electrical communication with the electronic display, speaker and/or tactile signal device and configured to advance the counting system by sending an electrical signal to the electronic display, speaker and/or tactile signal device upon an activation of the button/sensor, a reset button configured to reset the counting system by sending an electrical signal to the electronic display, speaker and/or tactile signal device upon an activation of the reset button, an accelerometer configured to detect a motion, wherein upon detecting a motion the accelerometer is configured to advance the counting system by sending an electrical signal to the display, speaker and/or tactile signal device, an integrated computer in communication with the electronic display, button, reset button, speaker, tactile signal device and accelerometer, and a computer program product comprising computer executable instructions embodied in a computer readable medium for performing steps comprising: receiving an electrical signal from the button/sensor, accelerometer or both, processing the electrical signal to calculate data to advance the counting system, and relaying the data to the electronic display, speaker and/or tactile signal device wherein the counting system is integrated into the cylindrical shaft of the crochet hook or knitting needle. Such a configuration can further comprise an optical device configured to optically capture data and transfer it to a computer, wherein the computer is configured to process the captured data and transmit it to the display, speaker tactile signal device, and/or an external device. Such a configuration can further comprise a wireless receiver/transmitter configured to receive and/or send data wirelessly. Such a configuration can further comprise a usb/port/receptacle configured to accept a hard wire for the transfer of power and/or information between hook/needle and an external device and/or power source. Such a configuration can further comprise a speaker that can relay information and/or instructions between hook/needle and/or computer and/or an external device.

A knitting system can also be provide comprising a knitting needle as described above, and a second knitting needle comprising a cylindrical shaft having a point at a first end and a blunt end or second point at an opposite end.

With respect to the above description and illustrations in FIGS. 1 to 4, it is to be realized that the optimum dimensional relationship for the various components of the depicted and described embodiments, to include variations in size, materials, shape, form, function, and the manner of operation, assembly and use, are deemed readily apparent to one of ordinary skill in the art, and all equivalent relationships to those illustrated in the drawings and described in the specification are intended to be encompassed by the disclosed and claimed subject matter.

Moreover, it shall be noted that those of ordinary skill in the art will readily recognize numerous adaptations and modifications which can be made to the various embodiments depicted in the Figures and described herein, all of which will fall within the spirit and scope of the present invention as defined in the disclosure and claims.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A knitting needle with fully integrated electronic counting system, comprising:

a cylindrical shaft comprising a body with a first end and a second end, wherein the first end comprises a point, and wherein the second end comprises a blunt end, wherein the body defines an outer wall; and an electronic counting system fully integrated within the outer wall of the body of the cylindrical shaft of the knitting needle, the counting system comprising:

a depressible button;

an activatable sensor, wherein an activation of the activatable sensor comprises an object covering or passing over the activatable sensor; and an electronic display and speaker, wherein the depressible button and activatable sensor are in electrical communication with the electronic display and speaker and configured to advance the counting system by sending an electrical signal to the electronic display and speaker upon an activation of the depressible button or activatable sensor, wherein the counting system is fully integrated within the outer wall of the body of the cylindrical shaft of the knitting needle.

2. The knitting needle of claim 1, wherein the cylindrical shaft has a length of about 7 to about 38 cm, and a diameter of about 0.6 mm to about 25 mm.

3. The knitting needle of claim 1, wherein the cylindrical shaft can be made of wood, plastic, metal, glass or ivory.

4. The knitting needle of claim 1, wherein the electronic display is located near the blunt end.

5. The knitting needle of claim 1, wherein the electronic display is configured to display a series of symbols, wherein the series of symbols comprises one or more of numbers, letters, characters or pictures.

6. The knitting needle of claim 5, wherein the electronic display comprises a light emitting diode (LED).

7. The knitting needle of claim 1, wherein the activatable sensor is located along the length of the cylindrical shaft, and wherein the depressible button is located at the blunt end of the cylindrical shaft.

8. The knitting needle of claim 1, further comprising a reset button configured to reset the counting system to a point of origin by sending an electrical signal to the electronic display upon an activation of the reset button.

9. The knitting needle of claim 1, further comprising an accelerometer configured to detect a motion, wherein upon detecting a motion the accelerometer is configured to advance the counting system by sending an electrical signal to the display and speaker.

10. The knitting needle of claim 1, further comprising an optical device configured to optically capture data and transfer it to a computer, wherein the computer is configured to process the captured data and transmit it to the display or speaker.

11. The knitting needle of claim 1, further comprising a wireless receiver configured to receive data, wherein the wireless receiver is configured to receive data wirelessly and transfer it to a computer, wherein the computer is configured to process the data and transmit it to the display or speaker.

12. The knitting needle of claim 1, further comprising a wireless receiver configured to transmit data, wherein the wireless receiver is configured to receive data wirelessly from an external device.

13. The knitting needle of claim 12, wherein the external device comprises a tablet, computer, phone, smart watch, audio device or display device.

14. The knitting needle of claim 1, further comprising a power source, a computer, memory, a receiver or transmitter, an accelerometer, or a speaker, wherein the power source, computer, memory, receiver or transmitter, display, accelerometer, external device, or speaker are interconnected with one another.

15. The knitting needle of claim 14, further comprising a computer readable medium comprising computer executable instructions for performing steps comprising:

(a) receiving an electrical signal from the button, accelerometer or external device;

(b) processing the electrical signal to calculate data to advance the counting system; and (c) relaying the data to the electronic display or speaker.

16. The knitting needle of claim 1, further comprising an additional knitting needle, wherein the additional knitting needle comprises a cylindrical shaft having a first end and a second end, wherein the first end comprises a point, and wherein the second end comprises a blunt end or a second point.

17. A knitting needle with a fully integrated electronic counting system, comprising:

a cylindrical shaft comprising a body with a first end and a second end, wherein the first end comprises a point, and wherein the second end comprises a blunt end, wherein the body defines an outer wall;

an electronic counting system fully integrated within the outer wall of the body of the cylindrical shaft, the counting system comprising:

an electronic display configured to display a series of symbols, wherein the series of symbols comprises one or more of letters, numbers, characters or pictures;

a button in electrical communication with the electronic display and configured to advance the counting system by sending an electrical signal to the electronic display upon an activation of the buttons;

a reset button configured to reset the counting system by sending an electrical signal to the electronic display upon an activation of the reset button;

an accelerometer configured to detect a motion, wherein upon detecting a motion the accelerometer is configured to advance the counting system by sending an electrical signal to the display;

an integrated computer in communication with the electronic display, button, reset button, and accelerometer; and a computer readable medium comprising computer executable instructions for performing steps comprising:

(a) receiving an electrical signal from the button, accelerometer or both;

(b) processing the electrical signal to calculate data to advance the counting system;

(c) relaying the data to the electronic display; and (d) interpreting a signal that translates to a pattern or a set of instructions, an optical device configured to optically capture data and transfer it to a computer, wherein the computer is configured to process the captured data and transmit it to the display or a speaker, or an external device;

a wireless receiver or transmitter configured to receive or send data wirelessly; and a speaker configured to relay audible information or instructions to the user, wherein the counting system is fully integrated within the outer wall of the body of the cylindrical shaft of the knitting needle.

* * * * *